US005485726A

United States Patent [19]

Shin et al.

[11] Patent Number: 5,485,726

[45] Date of Patent: Jan. 23, 1996

[54] PRESSURE CONTROL APPARATUS FOR STIRLING MODULE

[75] Inventors: Dong K. Shin, Kyungki-do; Sung T. Kim, Seoul, both of Rep. of Korea

[73] Assignee: LG Electronics Inc., Rep. of Korea

[21] Appl. No.: 441,453

[22] Filed: May 15, 1995

[30] Foreign Application Priority Data

May 17, 1994 [KR] Rep. of Korea ..... 10845/1994
Aug. 29, 1994 [KR] Rep. of Korea ..... 21424/1994

[51] Int. Cl.[6] ..... F01B 29/10; F02G 1/04

[52] U.S. Cl. ..... 60/519; 60/521; 92/181 P

[58] Field of Search ..... 60/517, 519, 521, 60/520, 910; 92/181 P, 184

[56] References Cited

U.S. PATENT DOCUMENTS

| | | | |
|---|---|---|---|
| 2,775,876 | 1/1957 | Schalwijk et al. | 60/521 |
| 2,781,632 | 2/1957 | Meijer | 60/521 |
| 2,794,315 | 6/1957 | Meijer | 60/521 |
| 2,867,973 | 1/1959 | Meyer | 60/521 |
| 2,943,453 | 7/1960 | Jonkers et al. | 60/517 |
| 3,396,976 | 8/1968 | Reinhoudt et al. | 92/184 |
| 4,711,091 | 12/1987 | Kawajiri et al. | 60/520 |
| 5,335,506 | 8/1994 | Byoung-Moo | 60/519 |

*Primary Examiner*—Ira S. Lazarus
*Assistant Examiner*—Alfred Basichas
*Attorney, Agent, or Firm*—Ostrolenk, Faber, Gerb & Soffen

[57] ABSTRACT

An improved pressure control apparatus for a stirling module capable of controlling a pressure between compression space and a bounce space by providing an improved pressure control apparatus, so that a high speed operation of a stirling module can be obtained, which includes a piston including a plurality of pressure control hole groups vertically extended within the piston for connecting between the compression space and the bounce space, each of groups consists of at least one hole; a pressure control member supporting section having a diameter smaller than that of the piston and upwardly extended from the top of the piston; a support member engaging section having a diameter smaller than that of the pressure control member supporting section and upwardly extended from the top of the support member engaging section; and a pressure control member including an engaging section threadly engaged to the pressure control member supporting section and an opening/closing section having a plurality of wings.

10 Claims, 7 Drawing Sheets

PRESSURE CONTROL APPARATUS FOR STIRLING MODULE

BACKGROUND OF THE INVENTION

1. Field of the Invention

The present invention relates to a pressure control apparatus for a stirling module, and in particular to an improved pressure control apparatus for a stirling module capable of controlling a pressure between a compression space and a bounce space by providing an improved pressure control apparatus, so that a high speed operation of a stirling module can be obtained.

2. Description of the Conventional Art

FIG. 1 shows a conventional stifling module. As shown therein, the conventional stirling module is provided with a driving casing 20 for encasing a driving section 10. Here, a predetermined portion of the driving section 10 is drivingly connected to a piston connection section 30*a*, integrally formed with a piston 30, by a pair of driving rods 40 so that a predetermined driving force is transferred from the driving section 10 to the piston 30 by the driving rods 40. A displacer rod hole 30*b* is vertically formed within the piston 30 and the piston connection section 30*a*. The driving section 10 is drivingly connected to a displacer 50 by a displacer connecting rod 60. Here, the displacer rod 60 slidably reciprocates along the displacer rod hole 30*b*. The piston 30 and the displacer 50 are encased by a cylinder inner wall 80 of a cylinder 70. A heater 90 is disposed on the top of the cylinder 70 for receiving heat from the portion over the top of the cylinder 70. A regenerator 100 which is disposed below the heater 90 is connected with the heater 90 for regenerating heat transferred from the heater 90. A cooler 110 is disposed below the regenerator 100 and connected with the regenerator 100.

Meanwhile, inside the cylinder 70, an expansion space 120 is formed between the upper surface of the displacer 50 and the heater 90. A compression space 130 is formed between the bottom of the displacer 50 and the upper surface of the piston 30. A bounce space 140 is formed below the piston 30.

Here, the compression space 130 and the bounce space 140 are interconnected by a pressure control tube 150, on the intermediate position of which a check valve 160 is disposed for controlling the pressure flowing through the pressure control tube 150.

The operation of a conventional stirling module will now be explained with reference to FIG. 1.

To begin with, the piston 30 and the displacer 50 downwardly/upwardly reciprocate along the cylinder inner wall 80. In accordance with the above reciprocating operation of the piston 30 and the displacer 50, the expansion space 120, the compression space 130, and the bounce space 140 are alternately expanded and compressed. That is, the working gas in the expansion space 120 is expanded when the displacer 50 moves downwardly. At this time, the working gas in the expansion space 120 becomes cooled. The cooled gas receives heat from the outside of the top of the heater 90. That is, the heat contained in the working gas is eliminated by the regenerator 100 and radiated toward the outside of the cylinder 70 by the cooler 110. The working gas not containing heat flows into the compression space 130 through a predetermined path (not shown) formed on a predetermined portion of the cylinder inner wall 80. Thereafter, when the displacer 50 moves downwardly, the working gas in the compression space 130 flows into the expansion space 120 again through the same path as the working gas flows into the compression space 130 that is, through the cooler 110, the regenerator 100, and the heater 90 in order. During the above operation, a predetermined level of pressure of working gas should be maintained between the compression space 130 and the bounce space 140 by controlling the check valve 160 disposed on the pressure control tube 150.

However, the conventional stirling module has disadvantages in correctly maintaining the pressure between the compression space and the bounce space. That is, since the pressure control tube which is relatively lengthy is connected between the compression space and the bounce space, more correct controls of the pressure therebetween cannot be obtained. In addition, since the pressure control tube is connected to be exposed to the outside of the cylinder, the stirling module is bulky.

SUMMARY OF THE INVENTION

Accordingly, it is an object of the present invention to provide a pressure control apparatus for a stirling module, which overcome the problems encountered in the conventional pressure control apparatus for a stirling module.

It is another object of the present invention to provide an improved pressure control apparatus for a stirling module capable of controlling a pressure between a compression space and a bounce space by providing an improved pressure control apparatus on a piston, so that a high speed operation of a stirling module can be obtained.

To achieve the above objects, there is provided a pressure control apparatus for a stirling module according to one aspect of the present invention, which includes a piston including a plurality of pressure control hole groups vertically extended within the piston for connecting between the compression space and the bounce space, each of groups consists of at least one hole; a pressure control member supporting section having a diameter smaller than that of the piston and upwardly extended from the top of the piston; a support member engaging section having a diameter smaller than that of the pressure control member supporting section and upwardly extended from the top of the support member engaging section; and a pressure control member including an engaging section threadly engaged to the pressure control member supporting section and an opening/closing section having a plurality of wings.

To achieve the above objects, there is provided a pressure control apparatus for a stirling module according to another aspect of the present invention, which includes a piston including a plurality of pressure control hole groups vertically extended within the piston for connecting between the compression space and the bounce space, each of groups consists of at least one hole; a pressure control member supporting section having a diameter smaller than that of the piston and upwardly extended from the top of the piston; a pressure control member fitted onto the pressure control member supporting section; and a fixing ring fitted onto the pressure control member supporting section for fixing the pressure control member.

DETAILED DESCRIPTION OF THE INVENTION

Figure 2A:
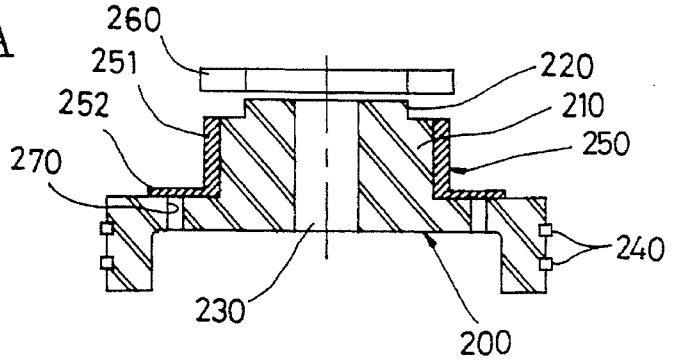
FIG. 2A is a cross-sectional view showing a pressure control apparatus for a stirling module according to a first embodiment of the present invention.
Figure 2B:
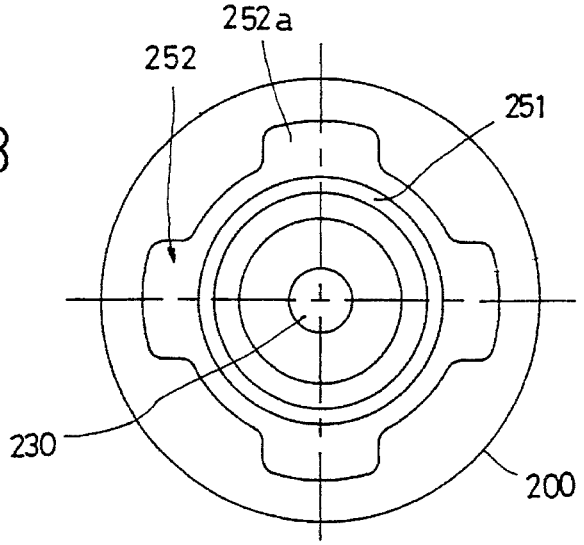
FIG. 2B is a top view of a pressure control apparatus for a stirling module of FIG. 2A according to the first embodiment of the present invention.
Figure 2C:
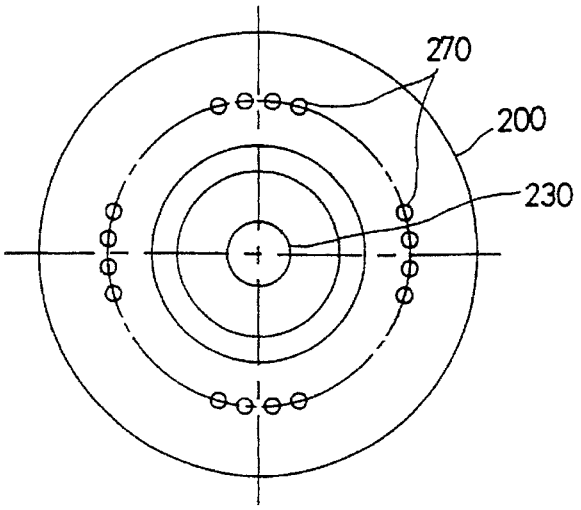
FIG. 2C is a top view of a piston of a pressure control apparatus for a stirling module of FIG. 2A according to the first embodiment of the present invention.

FIGS. 2A through 2C show a pressure control apparatus for a stirling module according to a first embodiment of the present invention.

The stirling module according to a first embodiment of the present invention has the same construction as the conventional stirling module except the pressure control apparatus, so the description of the construction of the stirling module is omitted except the pressure control apparatus which is improved for controlling the pressure between the compression space and the bounce space in the cylinder. In addition, the same reference numerals are used for the same construction as the conventional stirling module.

To begin with, a pressure control apparatus for a stirling module is provided with a pressure control member supporting section 210 which is integrally extended from the top of the piston 200 and has an outer diameter smaller than the piston 200. A support member engaging section 220 is integrally extended from the top of the pressure control member supporting section 210 for threadly receiving a ring-shaped support member 260 thereonto and has a diameter smaller than the pressure control member supporting section 210. A displacer rod hole 230 is formed within the piston 200, the pressure control member supporting section 210, and the support member engaging section 220 for receiving the displacer rod 60 (shown in FIG. 1) therein. A pair of piston rings 240 are disposed on the circumferential surface of the piston 200. A flange-shaped pressure control member 250 includes an engaging section 251 which is threadly engaged onto the pressure control member supporting section 210 and an opening/closing section 252 consisting of spaced-apart four flexible wings **252*a* and coming into contact with the upper surface of the piston 200. The support member 260 is threadly engaged onto the support member engaging section 220 for supporting the pressure control member 250**.

Meanwhile, a plurality of spaced-apart pressure control hole groups 270 are eccentrically formed on the upper surface of the piston 200. Here, each of the pressure control hole groups 270 consists of four holes for being coincident with the number of the wings **252*a***.

The operation of a pressure control apparatus for a stirling module according to a first embodiment of the present invention will now be explained with reference to FIGS. 2A through 2C.

Figure 1:
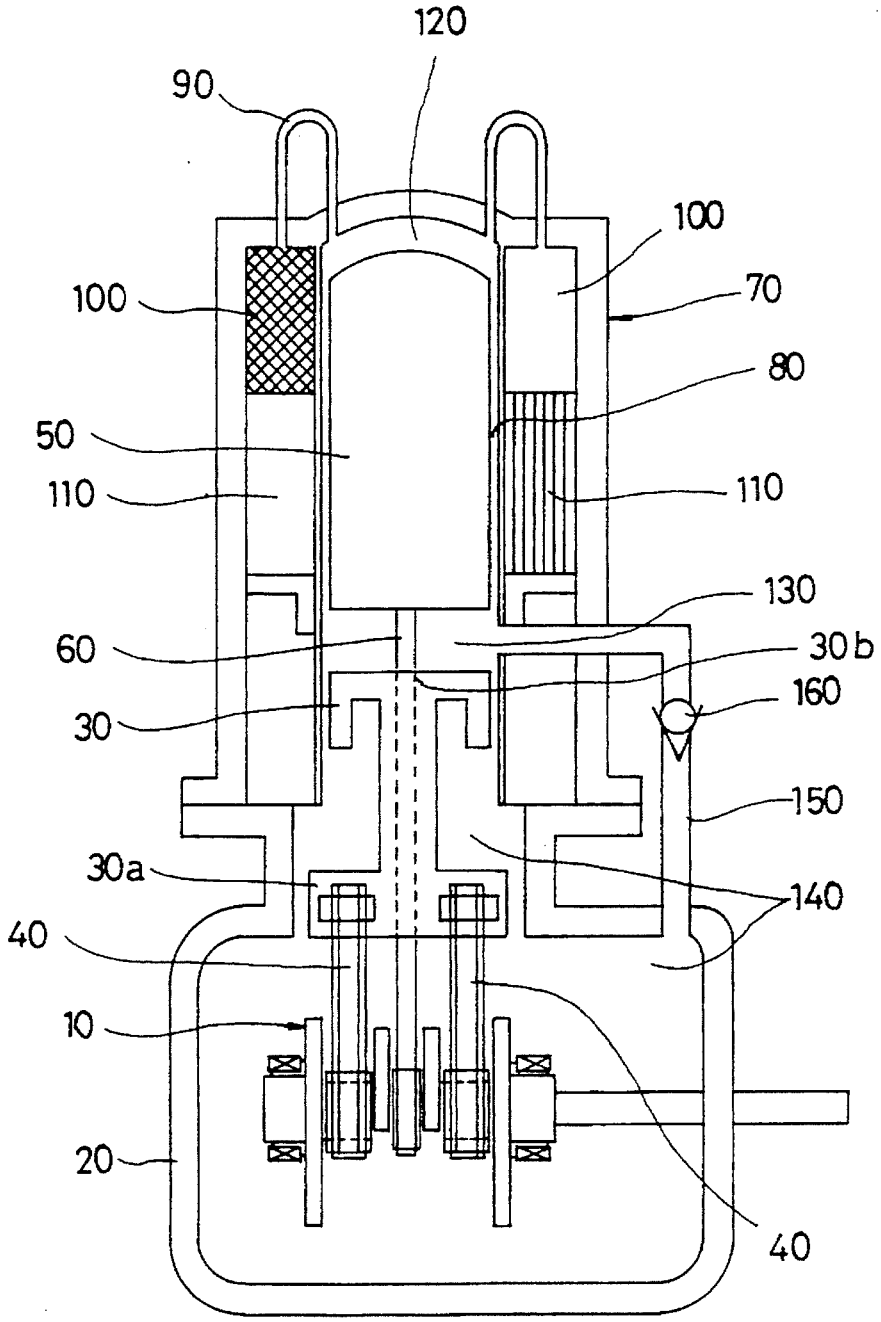
FIG. 1 CONVENTIONAL ART
FIG. 1 is a schematic cross-sectional view showing a conventional string module.

To begin with, while the piston 200 upwardly/downwardly reciprocates along the cylinder inner wall 80 (shown in FIG. 1), a predetermined pressure is generated both in the compression space 130 (shown in FIG. 1) and the bounce space 140 (shown in FIG. 1). Here, maintaining a predetermined level of pressure in the compression space 130 and the bounce space 140 is very important to ensure a stable operation of a stirling module. That is, when the piston 200 moves downwardly, the pressure transfers from the bounce space 140 to the compression space 130 through the pressure control hole group 270 by lifting the wings **252*a* of the opening/closing section 252, so that the pressure in the bounce space 140 transfers into the compression space 130**.

Meanwhile, when the piston 200 moves upwardly, the pressure applies onto every upper surfaces of the wings **252*a* of the opening/closing section 252, so that the pressure in the compression space 130 cannot transfers into the bounce space 140 through the pressure control hole groups 270**.

Figure 3A:
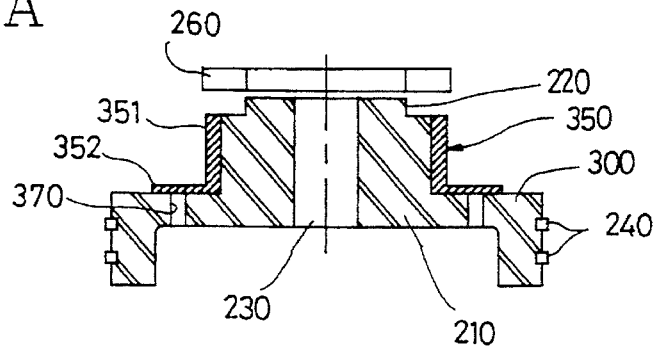
FIG. 3A is a cross-sectional view showing a pressure control apparatus for a stirling module according to a second embodiment of the present invention.
Figure 3B:
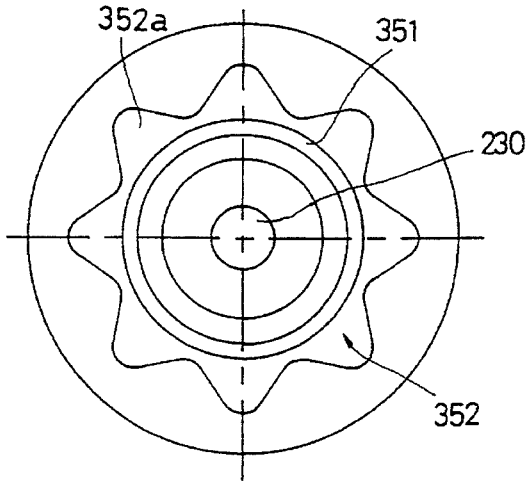
FIG. 3B is a top view of an opening/closing member of a pressure control apparatus for a stirling module of FIG. 3A according to the second embodiment of the present invention.
Figure 3C:
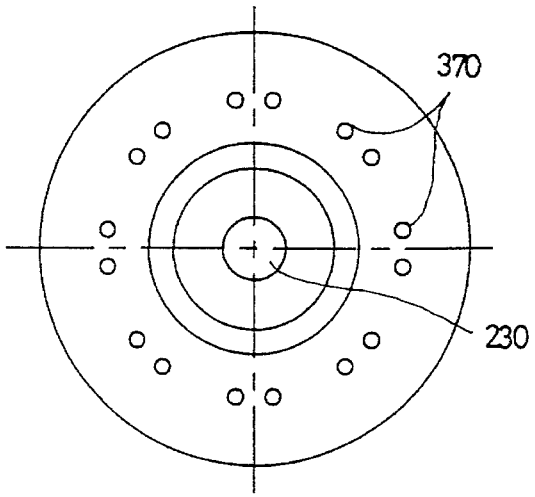
FIG. 3C is a top view of a piston of a pressure control apparatus for a stirling module of FIG. 3A according to the second embodiment of the present invention.

FIGS. 3A through 3C show a pressure control apparatus for a stirling module according to a second embodiment of the present invention.

The pressure control apparatus for a stirling module according to a second embodiment of the present invention has the same construction as the first embodiment except a closing/opening section 352 and a pressure control hole groups 370, so the description of the construction of the stirling module is omitted except the closing/opening section 352 and the pressure control hole groups 370. In addition, the same reference numerals are used for the same construction as the conventional stirling module.

To begin with, a flange-shaped pressure control member 350 includes an engaging section 351 threadly engaged to the outer circumferential surface of the pressure control member supporting section 210 and an opening/closing section 352 having a plurality of wings 352*a* and integrally extended from the engaging section 351 for coming into contact with the upper surface of the piston 300. The piston 300 includes a plurality of spaced-apart pressure control hole groups 370 which are eccentrically formed from the center of the piston 300, each of which consists of at least one hole. Here, the number of the pressure control hole groups 370 is coincident with the number of the wings 352*a* of the opening/closing section 352.

The operation of a pressure control apparatus for a stirling module according to a second embodiment of the present invention will now be explained with reference to FIGS. 3A through 3C.

To begin with, while the piston 300 upwardly/downwardly reciprocates along the cylinder inner wall 80 (shown in FIG. 1), a predetermined pressure is generated in the compression space 130 (shown in FIG. 1) and the bounce space 140 (shown in FIG. 1). Here, as described in the first embodiment, maintaining a predetermined level of pressure in the compression space 130 and the bounce space 140 is very important to ensure a stable operation of a stirling module. That is, when the piston 300 moves downwardly, the pressure transfers from the bounce space 140 to the compression space 130 through the pressure control hole group 370 by lifting the wings 352*a* of the opening/closing section 352, so that the pressure in the bounce space 140 transfers into the compression space 130.

Meanwhile, when the piston 300 moves upwardly, the pressure applies onto the upper surface of the wings 352*a* of the opening/closing section 352, so that the pressure in the compression space 130 cannot transfers into the bounce space 140 through the pressure control hole groups 370.

Figure 4A:
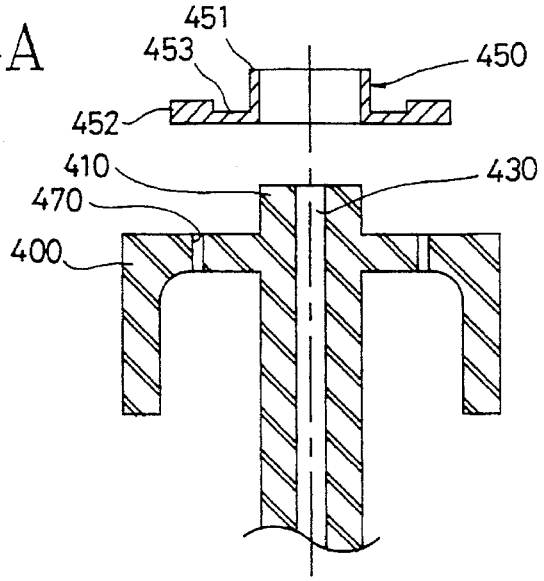
FIG. 4A is an exploded cross-sectional view showing a pressure control apparatus for a stirling module according to a third embodiment of the present invention.
Figure 4B:
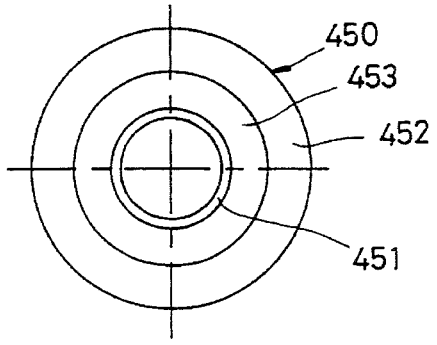
FIG. 4B is a top view of a pressure control section of a pressure control apparatus for a stirling module of FIG. 4A according to the third embodiment of the present invention.
Figure 4C:
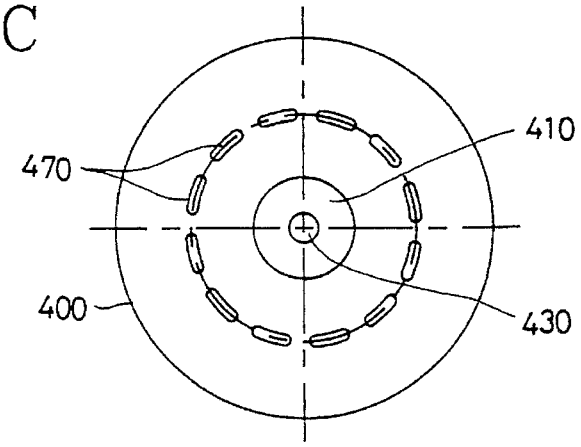
FIG. 4C is a top view of a piston of a pressure control apparatus for a stirling module of FIG. 4A according to the third embodiment of the present invention.

FIGS. 4A through 4C show a pressure control apparatus for a stirling module according to a third embodiment of the present invention.

The pressure control apparatus for a stirling module according to a third embodiment of the present invention has the same construction as the first embodiment except a closing/opening section 452 and a pressure control holes 470, so the description of the construction of the stirling module is omitted except the closing/opening section 452 and the pressure control hole groups 470. In addition, the same reference numerals are used for the same construction as the conventional stirling module.

To begin with, a flange-shaped pressure control member 450 includes an engaging section 451 threadly engaged to the outer circumferential surface of the pressure control member supporting section 410, a groove 453 having a predetermined width and integrally extended from the engaging section 451, and an opening/closing section 452 coming into contact with the upper surface of the piston 400. The piston 400 includes a plurality of spaced-apart pressure control holes 470 which are eccentrically formed from the center of the piston 400.

The operation of a pressure control apparatus for a stirling module according to a third embodiment of the present invention will now be explained with reference to FIGS. A through 4C.

To begin with, while the piston 400 upwardly/downwardly reciprocates along the cylinder inner wall 80 (shown in FIG. 1), a predetermined pressure is generated in the compression space 130 (shown in FIG. 1) and the bounce space 140 (shown in FIG. 1). Here, as described in the first embodiment, maintaining a predetermined level of pressure in the compression space 130 and the bounce space 140 is very important to ensure a stable operation of a stirling module. That is, when the piston 400 moves downwardly, the pressure transfers from the bounce space 140 to the compression space 130 through the pressure control holes 470 by lifting the opening/closing section 452, so that the pressure in the bounce space 140 transfers into the compression space 130.

Meanwhile, when the piston 400 moves upwardly, the pressure applies onto the upper surface of the opening/closing section 452, so that the pressure in the compression space 130 cannot transfers into the bounce space 140 through the pressure control holes 470.

Figure 5A:
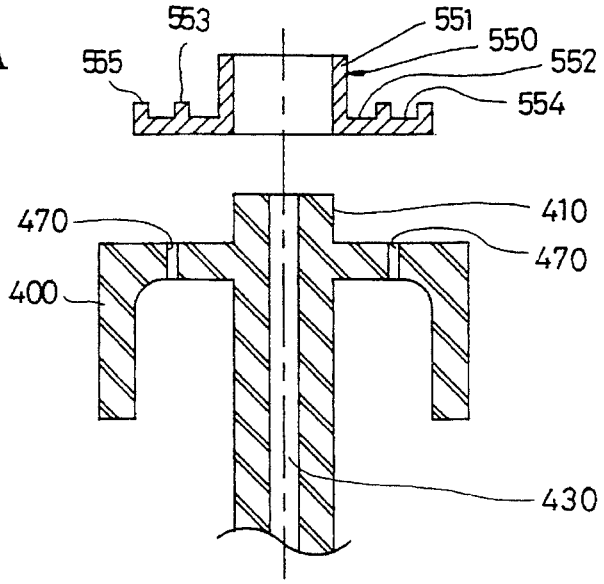
FIG. 5A is an exploded cross-sectional view showing a pressure control apparatus for a stirling module according to a fourth embodiment of the present invention.
Figure 5B:
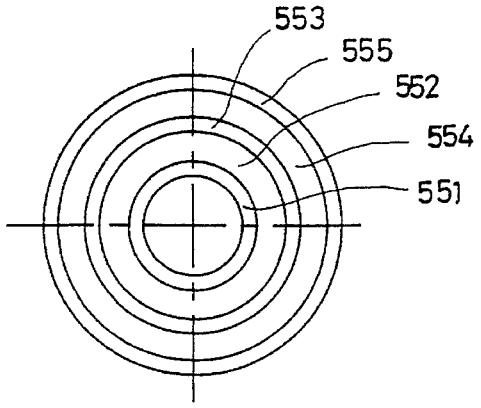
FIG. 5B is a top view of a pressure control section of a pressure control apparatus for a stirling module of FIG. 5A according to the fourth embodiment of the present invention.
Figure 5C:
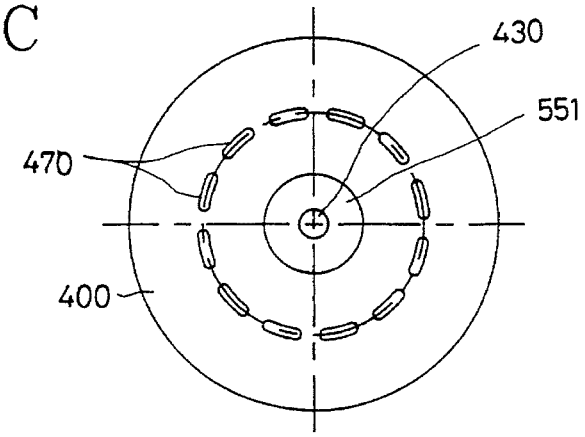
FIG. 5C is a top view of a piston of a pressure control apparatus for a stirling module of FIG. 5A according to the fourth embodiment of the present invention.

FIGS. 5A through 5C show a pressure control apparatus for a stirling module according to a fourth embodiment of the present invention.

The pressure control apparatus for a stirling module according to a fourth embodiment of the present invention has the same construction as the third embodiment except a closing/opening section 550, so the description of the construction of the stirling module is omitted except the closing/opening section 550. In addition, the same reference numerals are used for the same construction as the conventional stirling module.

To begin with, a flange-shaped pressure control member 550 includes an engaging section 551 threadly engaged to the outer circumferential surface of the pressure control member supporting section 410, a first groove 552 having a predetermined width and integrally extended from the engaging section 551, a first protrusion 553 integrally extended from the first groove 552, a second groove 554 integrally extended from the first protrusion 553, and a second protrusion 555 integrally extended from the second groove 554. Here, the first groove 552, the first protrusion 553, the second groove 554, and the second protrusion 555 come into contact with the upper surface of the piston 400. The piston 400 includes a plurality of spaced-apart pressure control holes 470 which are eccentrically formed from the center of the piston 400. The operation of a pressure control apparatus for a stirling module according to a fourth embodiment of the present invention will now be explained with reference to FIGS. 5A through 5C.

To begin with, while the piston 400 upwardly/downwardly reciprocates along the cylinder inner wall 80 (shown in FIG. 1), a predetermined pressure is generated in the compression space 130 (shown in FIG. 1) and the bounce space 140 (shown in FIG. 1). Here, as described in the first embodiment, maintaining a predetermined level of pressure in the compression space 130 and the bounce space 140 is very important to ensure a stable operation of a stirling module. That is, when the piston 400 moves downwardly, the pressure transfers from the bounce space 140 to the compression space 130 through the pressure control holes 470 by lifting the second groove 554 and the second protrusion 555, so that the pressure in the bounce space 140 transfers into the compression space 130.

Meanwhile, when the piston 400 moves upwardly, the pressure applies onto the upper surface of the first groove 552, the first protrusion 553, the second groove 554, and the second protrusion 555, so that the pressure in the compression space 130 cannot transfers into the bounce space 140 through the pressure control holes 470.

Figure 6A:
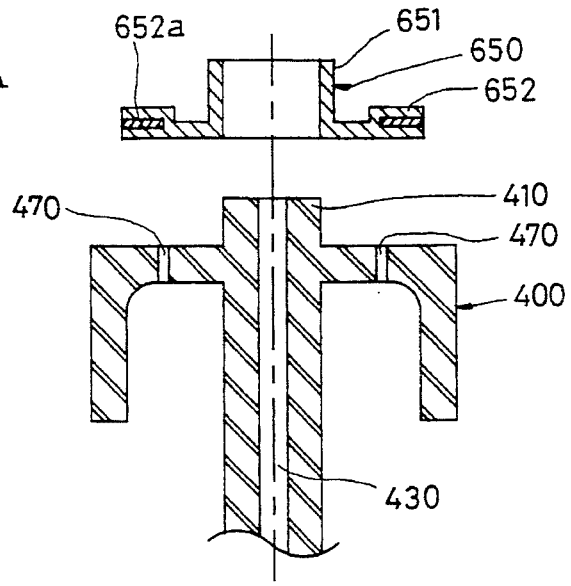
FIG. 6A is an exploded cross-sectional view showing a pressure control apparatus for a stirling module according to a fifth embodiment of the present invention.
Figure 6B:
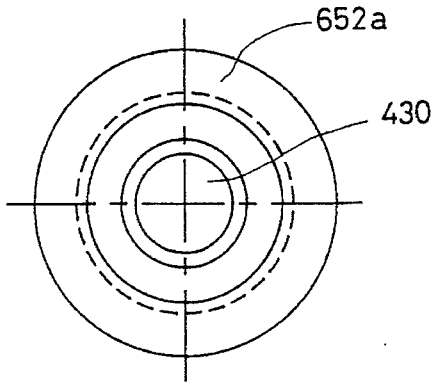
FIG. 6B is a top view of a pressure control section of a pressure control apparatus for a stirling module of FIG. 6A according to the fifth embodiment of the present invention.
Figure 6C:
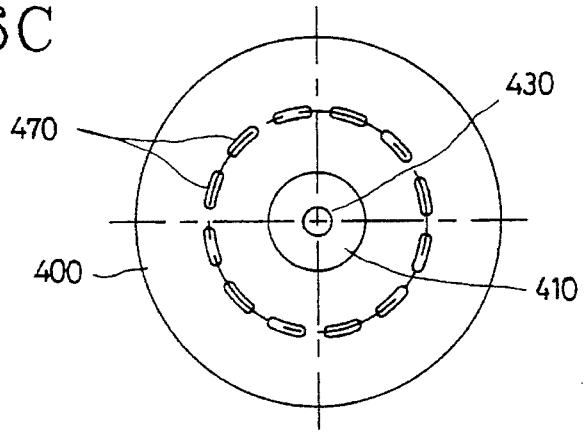
FIG. 6C is a top view of a piston of a pressure control apparatus for a stirling module of FIG. 6A according to the fifth embodiment of the present invention.

FIGS. 6A through 6C show a pressure control apparatus for a stirling module according to a fifth embodiment of the present invention.

The pressure control apparatus for a stirling module according to a fifth embodiment of the present invention has the same construction as the fourth embodiment except a pressure control member 650, so the description of the construction of the stirling module is omitted except the pressure control member 650. In addition, the same reference numerals are used for the same construction as the conventional stirling module.

To begin with, a flange-shaped pressure control member 650 includes an engaging section 651 threadly engaged to the outer circumferential surface of the pressure control member supporting section 410 and an opening/closing section 652 integrally extended from the engaging section 651 having a circular ring-shaped support member 652*a* embedded into the opening/closing section 652. Here, the opening/closing section 652 comes contact with the upper surface of the piston 400. The piston 400 includes a plurality of spaced-apart pressure control holes 470 which are eccentrically formed from the center of the piston 400.

The operation of a pressure control apparatus for a stirling module according to a fifth embodiment of the present invention will now be explained with reference to FIGS. 6A through 6C.

To begin with, while the piston 400 upwardly/downwardly reciprocates along the cylinder inner wall 80 (shown in FIG. 1), a predetermined pressure is generated in the compression space 130 (shown in FIG. 1) and the bounce space 140 (shown in FIG. 1). Here, as described in the first embodiment, maintaining a predetermined level of pressure in the compression space 130 and the bounce space 140 is very important to ensure a stable operation of a stirling module. That is, when the piston 400 moves downwardly, the pressure transfers from the bounce space 140 to the compression space 130 through the pressure control holes 470 by lifting the opening-closing section 652, so that the pressure in the bounce space 140 transfers into the compression space 130.

Meanwhile, when the piston 400 moves upwardly, the pressure applies onto the upper surface of the opening/closing section 652, so that the pressure in the compression space 130 cannot transfers into the bounce space 140 through the pressure control holes 470.

Figure 7A:
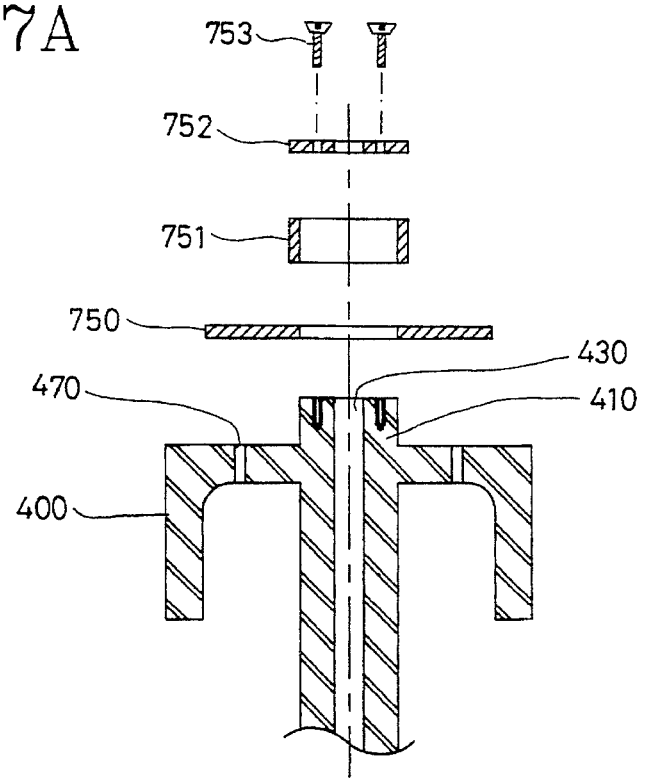
FIG. 7A is an exploded cross-sectional view showing a pressure control apparatus for a stirling module according to a sixth embodiment of the present invention.
Figure 7B:
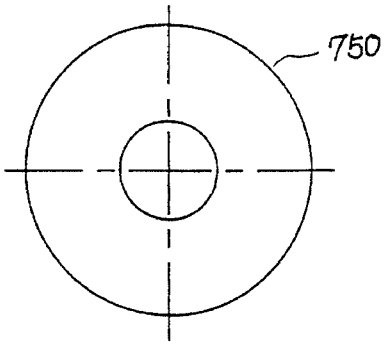
FIG. 7B is a top view of a pressure control section of a pressure control apparatus for a stirling module of FIG. 7A according to the sixth embodiment of the present invention.
Figure 7C:
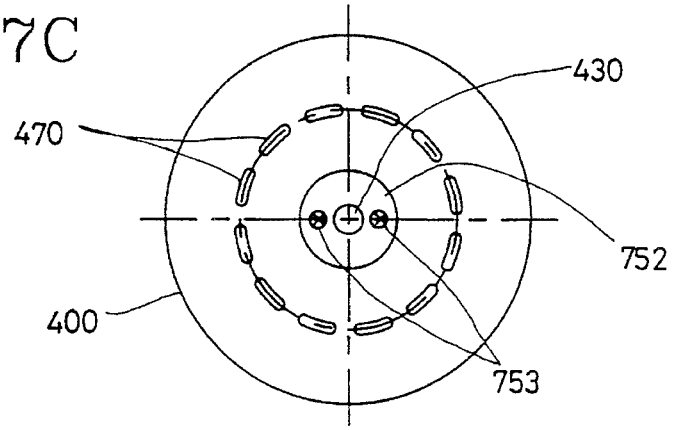
FIG. 7C is a top view of a piston of a pressure control apparatus for a stirling module of FIG. 7A according to the sixth embodiment of the present invention.

FIGS. 7A through 7C show a pressure control apparatus for a stirling module according to a sixth embodiment of the present invention.

The pressure control apparatus for a stirling module according to a sixth embodiment of the present invention has the same construction as the fifth embodiment except a pressure control member 750, a plurality of screws 753, a fixing plate 752, and a fixing ring 751, so the description of the construction of the stirling module is omitted except the pressure control member 750, the screws 753, the fixing plate 752, and the fixing ring 751. In addition, the same reference numerals are used for the same construction as the conventional stirling module.

To begin with, the ring-shaped pressure control member 750 is fitted onto the pressure control support member 410. Thereafter, the ring-shaped fixing plate 751 is fitted onto the pressure control support member 410, downwardly pressing the pressure control member 750. Finally, the fixing plate 752 is fixed on the fixing plate 751 by screws 753. Here, the opening/closing section 750 comes contact with the upper surface of the piston 400. The piston 400 includes a plurality of spaced-apart pressure control holes 470 which are eccentrically formed from the center of the piston 400.

The operation of a pressure control apparatus for a stirling module according to a fifth embodiment of the present invention will now be explained with reference to FIGS. 7A through 7C.

To begin with, while the piston 400 upwardly/downwardly reciprocates in the cylinder inner wall 80 (shown in FIG. 1), a predetermined pressure is generated in the compression space 130 (shown in FIG. 1) and the bounce space 140 (shown in FIG. 1). Here, as described in the first embodiment, maintaining a predetermined level of pressure in the compression space 130 and the bounce space 140 is very important to ensure a stable operation of a stirling module. That is, when the piston 400 moves downwardly, the pressure transfers from the bounce space 140 to the compression space 130 through the pressure control holes 470 by lifting the opening/closing section 750, so that the pressure in the bounce space 140 transfers into the compression space 130.

Meanwhile, when the piston 400 moves upwardly, the pressure applies onto the upper surface of the opening/closing section 750, so that the pressure in the compression space 130 cannot transfers into the bounce space 140 through the pressure control holes 470.

As described above, the pressure control apparatus for a stirling module is directed to advantageously control the pressure transference between the compression space and the bounce space when a piston reciprocates in the inner wall of a cylinder of a stirling module at a relatively high speed.

What is claimed is:

1. A pressure control apparatus for a stirling module wherein a compression space is formed between a displacer and a piston in a cylinder and a bounce space formed below said piston in said cylinder, comprising:

a piston including a plurality of pressure control hole groups vertically extended within said piston for connecting between said compression space and said bounce space, each of groups consists of at least one hole;

a pressure control member supporting section having a diameter smaller than that of the piston and upwardly extended from the top of the piston;

a support member engaging section having a diameter smaller than that of said pressure control member supporting section and upwardly extended from the top of the support member engaging section; and a pressure control member including an engaging section threadly engaged to said pressure control member supporting section and an opening/closing section having a plurality of wings.

2. The apparatus of claim 1, wherein the number of said wings is coincident with the number of said pressure control hole groups.

3. The apparatus of claim 1, wherein said pressure control hole groups are spaced apart from one another.

4. The apparatus of claim 1, wherein said pressure control hole groups are eccentrically formed from a center of the piston.

5. The apparatus of claim 1, wherein between said engaging section and said opening/closing section are formed at least one groove.

6. The apparatus of claim 1, wherein between said engaging section and said opening/closing section are formed at least one protrusion.

7. The apparatus of claim 6, wherein said protrusion includes a support member embedded therewithin.

8. The apparatus of claim 1, wherein said hole of the pressure control hole groups is elongatedly formed.

9. The apparatus of claim 1, wherein said pressure control apparatus for a stirling module further includes a support member threadly engaged onto said support member engaging section for fixing ,said pressure control member.

10. A pressure control apparatus for a stirling module wherein a compression space is formed between a displacer and a piston in a cylinder and a bounce space is formed below said piston in said cylinder, comprising:

a piston including a plurality of pressure control hole groups vertically extended within said piston for connecting between said compression space and said bounce space, each of groups consists of at least one hole;

a pressure control member supporting section having a diameter smaller than that of the piston and upwardly extended from the top of the piston;

a pressure control member fitted onto said pressure control member supporting section; and fixing means fitted onto the pressure control member supporting section for fixing the pressure control member.

* * * * *